US008062434B2

(12) United States Patent
Yi et al.

(10) Patent No.: US 8,062,434 B2
(45) Date of Patent: Nov. 22, 2011

(54) CLEANING DEVICE FOR CLEANING NOZZLES OF SMT MACHINES

(75) Inventors: Bin Yi, Shanghai (CN); Xin-Sheng Wang, Shanghai (CN); Li Cong, Shanghai (CN)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 366 days.

(21) Appl. No.: 12/534,281

(22) Filed: Aug. 3, 2009

(65) Prior Publication Data

US 2010/0236586 A1 Sep. 23, 2010

(30) Foreign Application Priority Data

Mar. 18, 2009 (CN) ..... 2009 2 0301383 U

(51) Int. Cl.
*B08B 3/04* (2006.01)

(52) U.S. Cl. ..... 134/166 C; 134/169 C; 134/102.2

(58) Field of Classification Search ..... 134/166 C, 134/169 C, 135, 102.2
See application file for complete search history.

(56) References Cited

U.S. PATENT DOCUMENTS

| | | | | | |
|---|---|---|---|---|---|
| 1,187,566 | A | * | 6/1916 | Taylor | 206/369 |
| 1,400,797 | A | * | 12/1921 | Burnham | 134/167 R |
| 2,413,858 | A | * | 1/1947 | Borgeat | 206/210 |
| 2,454,602 | A | * | 11/1948 | Gunther | 206/210 |
| 2,519,654 | A | * | 8/1950 | Heaney | 134/103.1 |
| 2,818,979 | A | * | 1/1958 | Rose | 211/60.1 |
| 2,827,063 | A | * | 3/1958 | Roy | 134/171 |
| 2,970,700 | A | * | 2/1961 | Lacy et al. | 211/74 |
| 3,834,409 | A | * | 9/1974 | Kuparinen | 134/117 |
| 4,305,759 | A | * | 12/1981 | Westhoff et al. | 134/22.12 |
| 4,356,830 | A | * | 11/1982 | Holzapfel | 134/152 |
| 4,381,016 | A | * | 4/1983 | Douglas et al. | 134/170 |
| 5,078,164 | A | * | 1/1992 | Doellgast | 134/166 R |
| 5,415,697 | A | * | 5/1995 | MacDonald et al. | 134/26 |
| 5,839,457 | A | * | 11/1998 | Rijken et al. | 134/110 |
| 6,033,487 | A | * | 3/2000 | Goldston et al. | 134/21 |
| 6,336,976 | B1 | * | 1/2002 | Usui | 134/1 |
| 6,405,741 | B1 | * | 6/2002 | McCully | 134/186 |
| 6,475,444 | B1 | * | 11/2002 | Zimmermann et al. | 422/551 |
| 6,955,180 | B2 | * | 10/2005 | Kocherlakota et al. | 134/169 C |
| 7,789,969 | B2 | * | 9/2010 | Rabinovich et al. | 134/21 |

FOREIGN PATENT DOCUMENTS

| | | |
|---|---|---|
| CN | 2374273 Y | 4/2000 |
| CN | 2555954 Y | 6/2003 |
| CN | 2603926 Y | 2/2004 |

* cited by examiner

*Primary Examiner* — Frankie L Stinson
(74) *Attorney, Agent, or Firm* — Altis Law Group, Inc.

(57) ABSTRACT

A cleaning device to clean a plurality of nozzles of a surface-mount technology (SMT) includes a first cleaning container, a supporting board, a filtering member, a second cleaning container and a connection member. The first cleaning container defines a first opening in a bottom thereof. The supporting board to fix the plurality of nozzles is connected to the bottom of the first container. The filtering member is located at a bottom of the supporting board. The second cleaning container is connected to the filtering member, and operable to receive cleaning fluid. The connection member is connected the first cleaning container and the second cleaning container. Injection of air to the first cleaning container and the second cleaning container allows the cleaning fluid to circularly flow through the second cleaning container, the connection member, the first cleaning container, the supporting board, and the filtering member to clean the plurality of nozzles.

12 Claims, 4 Drawing Sheets

CLEANING DEVICE FOR CLEANING NOZZLES OF SMT MACHINES

BACKGROUND

1. Technical Field

The disclosure relates to cleaning devices, and more particularly to a cleaning device for cleaning nozzles of surface-mount technology (SMT) machines.

2. Description of Related Art

Nozzles of SMT machines are used to suck up electrical parts to solder them on a printed circuit board. FIG. 1 is a schematic view of a nozzle 50 of SMT machines. The nozzle 50 includes a hollow pipe 51, a baffle-board 52, and a sucker 53 in communication with the hollow pipe 51. The baffle-board 52 is disposed between the hollow pipe 51 and the sucker 53, and has a substantially umbrella shape. Frequently, soldering tins that remain in the nozzle 50 are cleaned by a cloth with a cleaning fluid. However, it is difficult to clean the soldering tins that remain in inner surfaces of the hollow pipe 51 and the sucker 53 after SMT process because of the small diameters of the hollow pipe 51 and the sucker 53, resulting in fail of sucking up the electrical parts.

Therefore, a need exists in the industry to overcome the described limitations.

DETAILED DESCRIPTION

Figure 1:
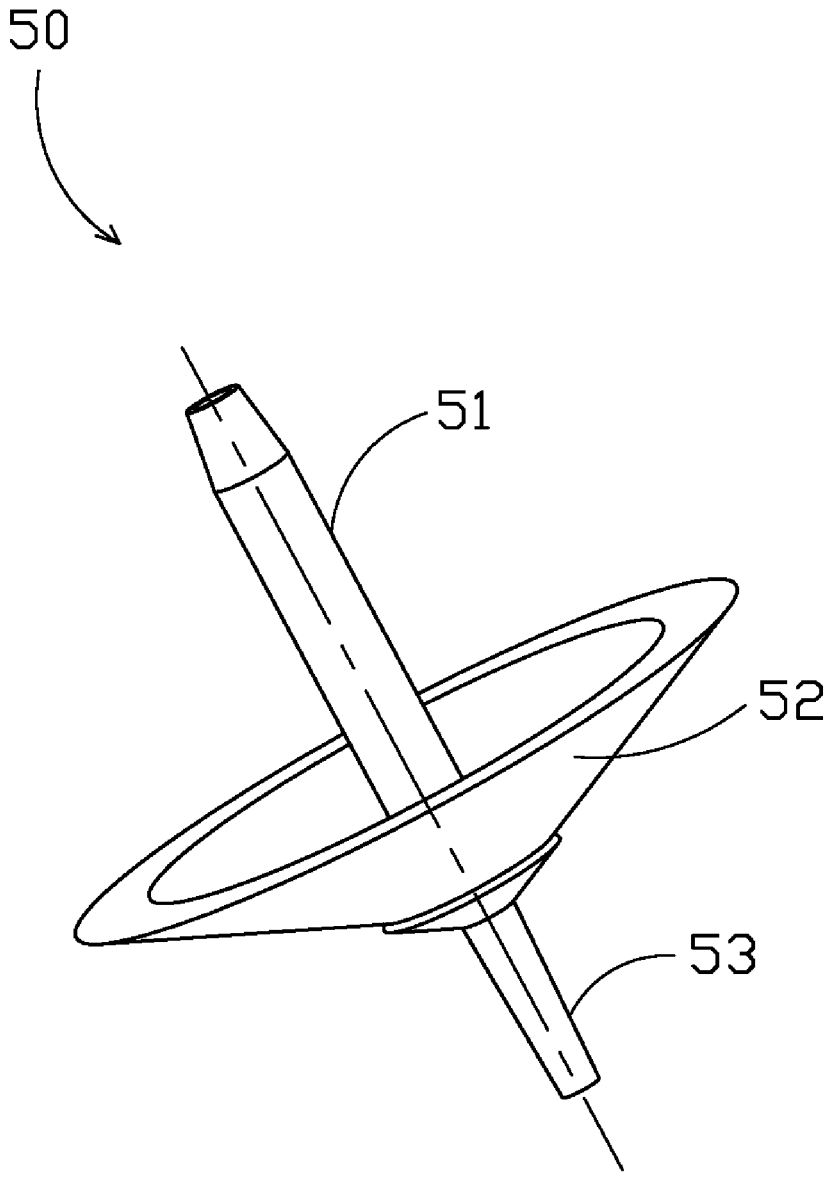
FIG. 1 is a schematic view of a nozzle of SMT machines.

FIG. 1 is a schematic view of a nozzle 50 of SMT machines. The nozzle 50 includes a hollow pipe 51, a baffle-board 52, and a sucker 53 in communication with the hollow pipe 51. The baffle-board 52 is disposed between the hollow pipe 51 and the sucker 53, and has a substantially umbrella shape.

Figure 2:
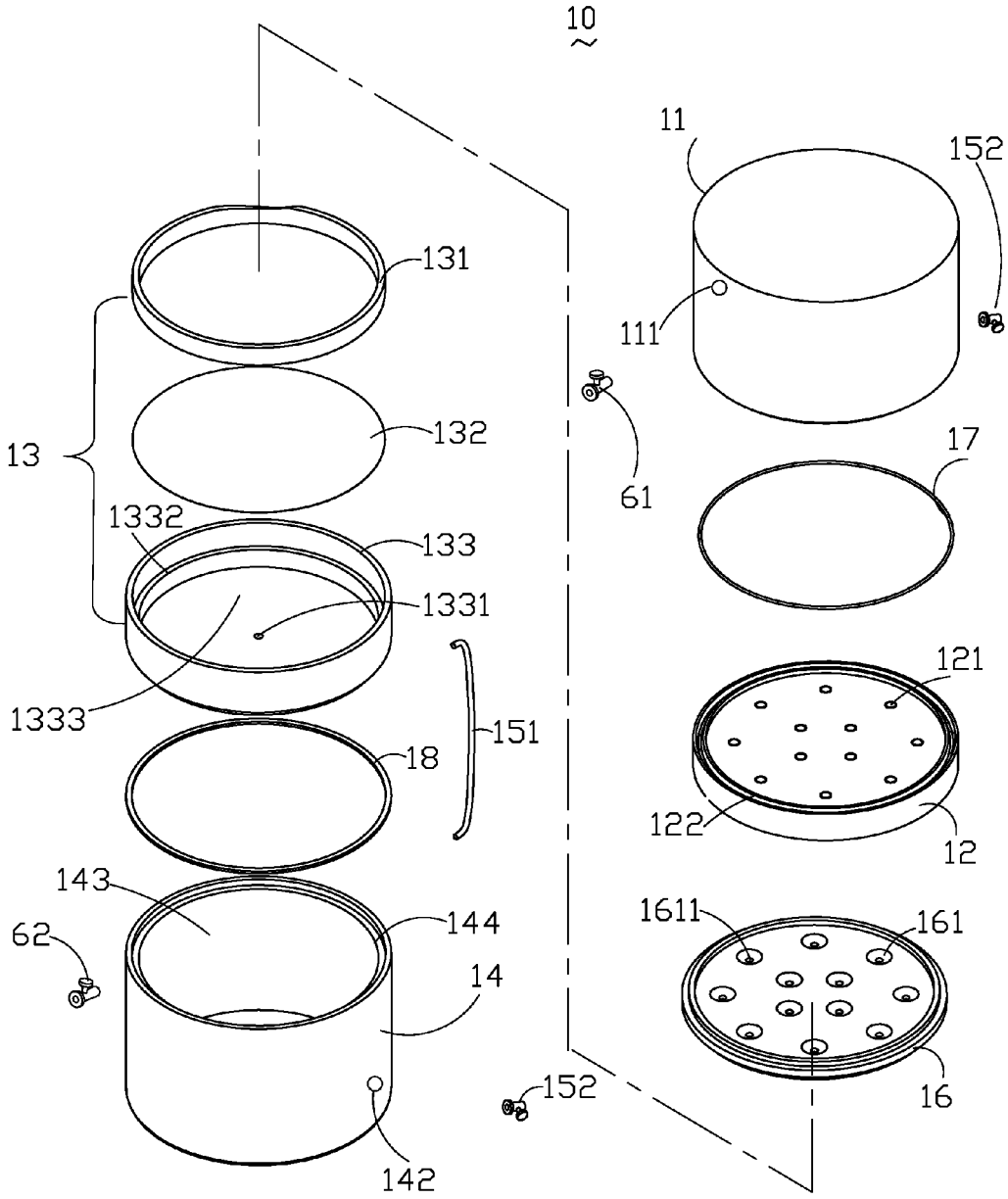
FIG. 2 is an exploded, isometric perspective view of a cleaning device of the disclosure.

FIG. 2 is an exploded, isometric perspective view of a cleaning device 10 of the disclosure. The cleaning device 10 is operable to clean a plurality of nozzles 50 of an SMT machine, and includes a first cleaning container 11, a supporting board 12, a securing board 16, a filtering member 13, a second cleaning container 14, and a connection member 15.

Figure 4:
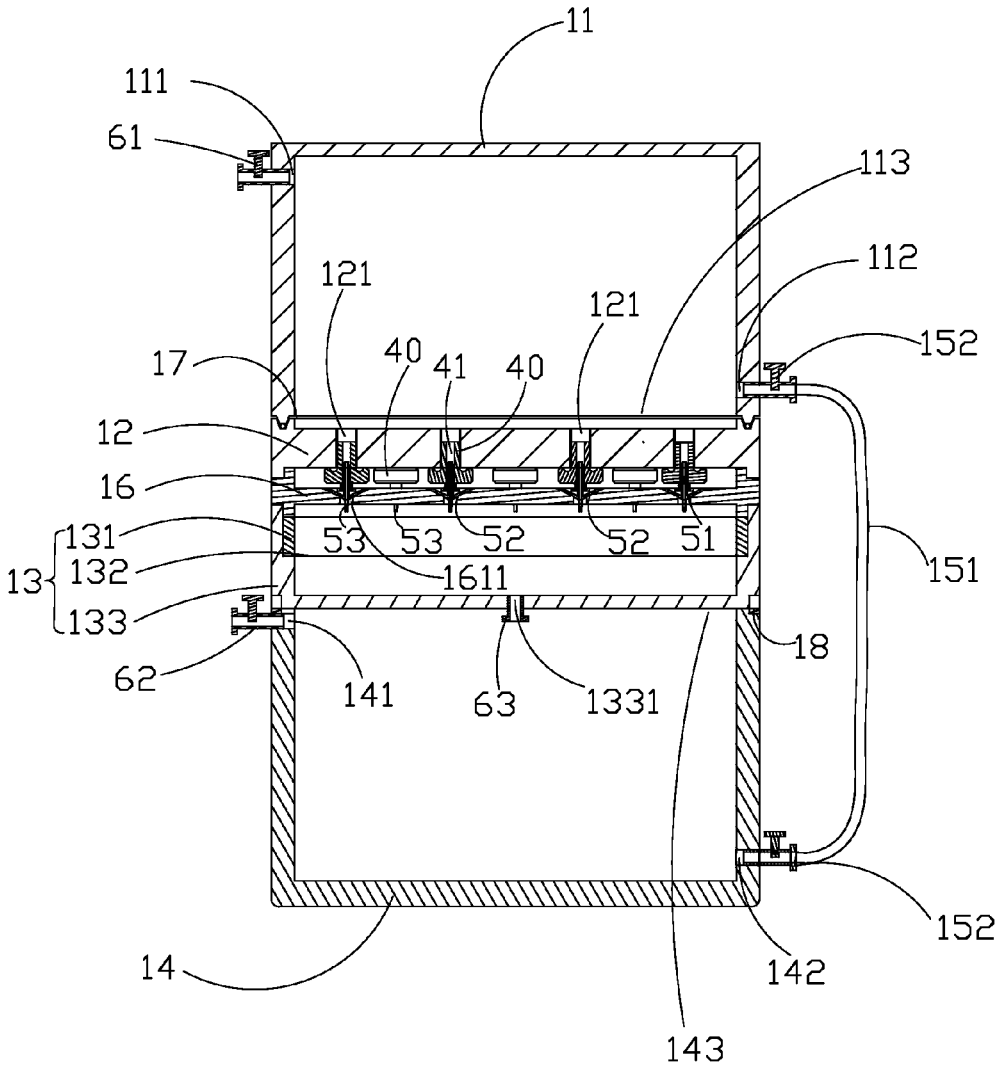
FIG. 4 is a cross section along line IV-IV of FIG. 3, in which sealing members and nozzles are implemented.

The first cleaning container 11 defines an first opening 113 (referring to FIG. 4) in a bottom thereof, a first air injecting hole 111 to allow air flow into the first cleaning container 11, and a fluid injecting hole 112 spaced from the first air injecting hole 111. A first valve 61 is mounted in the first air injecting hole 111 so as to switch on or off the first air injecting hole 111. In the illustrated embodiment, the first air injecting hole 111 is defined in a sidewall adjacent to a top of the first container 11. The fluid injecting hole 112 is defined in the sidewall adjacent to the bottom of the first container 11.

The supporting board 12 is connected to the bottom of the first container 11, and defines a first round slot 122 in the top side thereof, and a plurality of first through holes 121 surrounded by the first round slot 122. A first sealing ring 17 is received in the first round slot 122 of the supporting board 12 so as to ensure that the supporting board 12 is hermetically attached to the first container 11. The plurality of first through holes 121 extends through the supporting board 12 to receive a plurality of sealing members 40. The plurality of sealing members 40 are positioned so as to hermetically fix the plurality of nozzles 50 to the supporting board 12. In the illustrated embodiment, the plurality of sealing members 40 may be made of a rubber material. Each of the plurality of sealing members 40 defines a second through hole 41 to receive the hollow pipe 51 of each of the plurality of nozzles 50. After assembly, each of the plurality of nozzles 50 is fixed in the supporting board 12 with the second through hole 41 of each of the plurality of sealing members 40 in communication with each of the plurality of first through holes 121 of the supporting board 12. In this position, the hollow pipe 51 of each of the plurality of nozzles 50 is in communication with each of the plurality of first through holes 121 of the supporting board 12, so that the cleaning fluid flows through the hollow pipe 51 of each of the plurality of nozzles 50.

The filtering member 13 is located at a bottom of the supporting board 12, and is operable to filter the soldering tins from the cleaning fluid, so that the cleaning fluid without any soldering tins flows into the second cleaning container 14. The filtering member 13 includes a sleeve 131, a filtering film 132, and a filtering container 133. The filtering container 133 includes a step 1332 located in a middle portion of an inner sidewall thereof. The filtering film 132 is located at the step 1332 of the filtering container 133, and the sleeve 131 is disposed between the filtering film 132 and the supporting board 12 after assembly. The sleeve 131 is positioned so as to fix the filtering film 132 on the step 1332 of the filtering container 133. The filtering container 133 defines a second opening 1333 in a top portion thereof and a receiving hole 1331 in a bottom of the filtering container 133 and in communication with the second opening 1333. A non-returning valve 63 (referring to FIG. 4) is mounted in the receiving hole 1331 so as to ensure the cleaning fluid flowing from the first cleaning container 11 to the second cleaning container 14, not from the second cleaning container 14 to the first cleaning container 11 during a cleaning process. In this position, the cleaning fluid with soldering tin is filtered out by the filtering film 132, when the cleaning fluid flows from the first cleaning container 11 to the second cleaning container 14.

The cleaning device 10 further includes a securing board 16 located between the supporting board 12 and the sleeve 131 of the filtering member 13. The securing board 16 includes a plurality of recesses 161 to receive the baffle-boards 52 of the plurality of nozzles 50. Each of the plurality of recesses 161 of the securing board 16 defines a third through hole 1611 in a bottom thereof. After assembly, each of the plurality of the nozzles 50 is fixed on the supporting board 12 with the sucker 53 of each of the plurality of nozzles 50 passing through the third through hole 1611 of each of the plurality of recesses 161. In use, the cleaning fluid flows through the inner surface of the hollow pipe 51 and the sucker 53 of each of the plurality of nozzles 50, to clean the soldering tin that remain in the inner surface of the hollow pipe 51 and the sucker 53 of each of the plurality of nozzles 50, and avoid the cleaning fluid dropping on the baffle-board 53 of each of the plurality of nozzles 50.

Alternatively, the securing board 16 can be omitted.

The second cleaning container 14 is connected to the filtering container 133, and is operable to receive the cleaning fluid. The second cleaning container 14 defines a third opening 143 at a top thereof, and a second round slot 144 surrounding the third opening 143. A second sealing ring 18 is received in the second round slot 144 of the second cleaning container 14 so as to ensure that the filtering container 133 is hermetically attached to the second container 11. The second cleaning container 14 defines a second air injecting hole 141 in the sidewall adjacent to the third opening 143 of the second cleaning container 14, and a fluid outgoing hole 142 in the sidewall adjacent to a bottom of the second cleaning container 14. The second air injecting hole 141 is defined so as to allow air to flow into the second cleaning container 14. A second valve 62 is received in the second air injecting hole 141 to switch on or off the second air injecting hole 141 of the second cleaning container 14. The fluid outgoing hole 142 is structured to release the cleaning fluid in the second cleaning container 14.

The connection member 15 connects the fluid injecting hole 112 of the first cleaning container 11 and the fluid outgoing hole 142 of the second cleaning container 14, and is positioned so as to switch on or off communication between the first cleaning container 11 and the second cleaning container 14. The connection member 15 includes a connection pipe 151 connecting the fluid injecting hole 112 of the first cleaning container 11 and the fluid outgoing hole 142 of the second cleaning container 14, and a pair of valves 152 respectively mounted in the fluid injecting hole 112 and the fluid outgoing hole 142 so as to switch on or off communication between the first cleaning container 11 and the second cleaning container 14. In use, the cleaning fluid flows from the second cleaning container 14 to the first cleaning container 11 via the connection member 15.

In assembly, the plurality of sealing members 40 are fixed on the supporting board 12, and the plurality of nozzles 50 are fixed on each of the plurality of sealing members 40.

Figure 3:
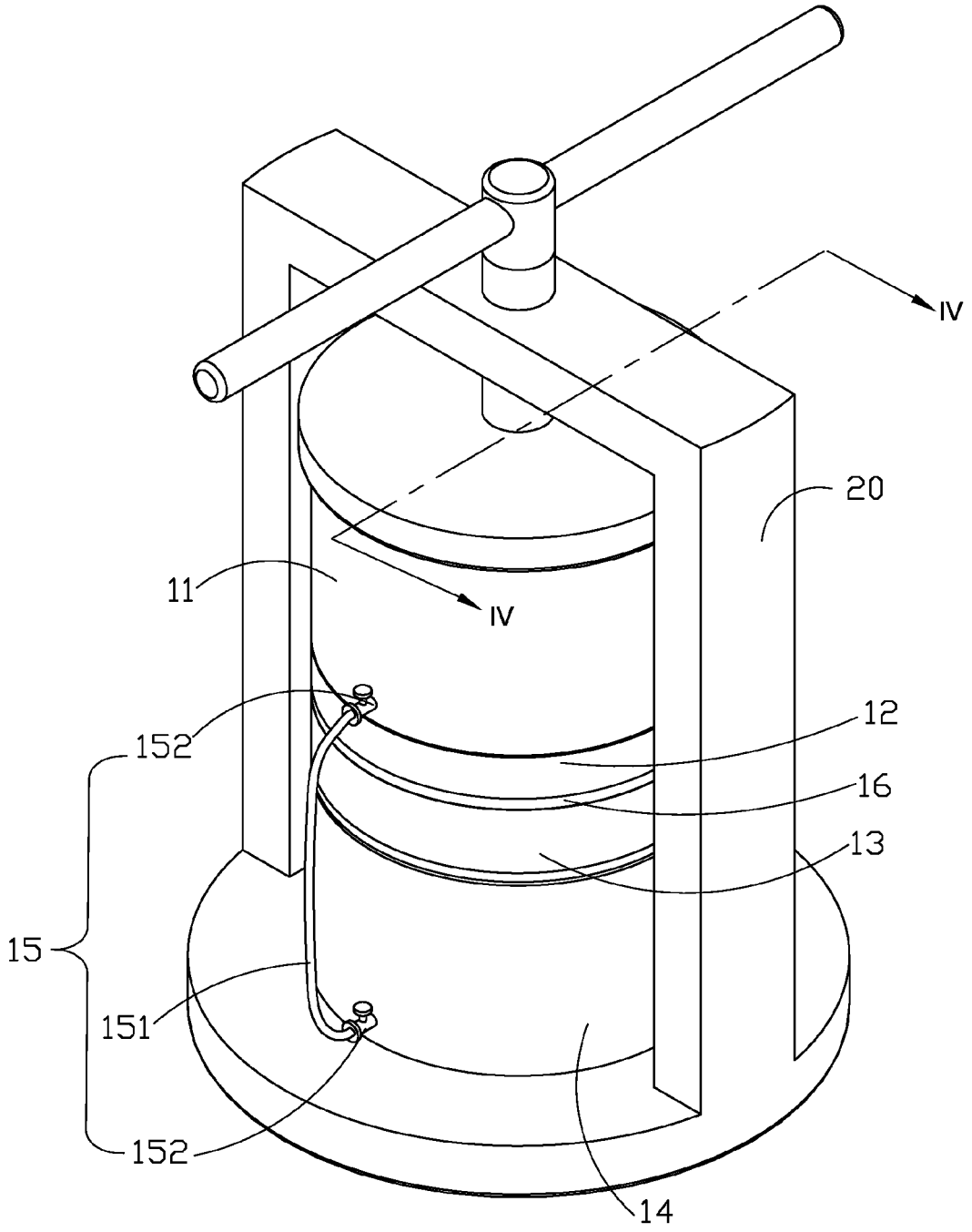
FIG. 3 is an assembled view of FIG. 2, in which the cleaning device is mounted on a base.

The second cleaning container 14 receives the cleaning fluid. The filtering member 13 is located at the top of the second cleaning container 14. The securing board 16 is located at the top of the filtering member 13. The supporting board 12 is located at the securing board 16 with the baffle-board 52 of each of the plurality of the nozzles 50 received in each of the plurality of recesses 161 of the securing board 16, and the sucker 53 of each of the plurality of the nozzles 50 passing through the third through hole 1611 of the plurality of recesses 161 of the securing board 16. The first cleaning container 11 is located at the supporting board 12. The connection member 15 connects the fluid injecting hole 112 of the first cleaning container 11 and the fluid outgoing hole 142 of the second cleaning container 14. In this position, the cleaning device 10 is assembled with the cleaning fluid received in the second cleaning container 14 and the plurality of nozzles 50 fixed in the supporting board 12. The cleaning device 10 is mounted on a base 20 before cleaning the plurality of nozzles 50 (referring to FIG. 3).

In use, the pair of valves 152 and the second valve 62 are turned on so as to allow air to flow into the second cleaning container 14. The cleaning fluid flows from the second cleaning container 14 to the first cleaning container 11 under air pressure generated by airflow. Here, the pair of valves 152 and the second valve 62 are turned off, and the first valve 61 is turned on so as to allow air to flow into the first cleaning container 11. The cleaning fluid flows from the first cleaning container 11 to the second cleaning container 14 under the air pressure generated by the airflow. In detail, the cleaning fluid flows through the inner surface of the hollow pipe 51 and the sucker 53 of each of the plurality of nozzles 50 with the soldering tins in the inner surface of the hollow pipe 51 washed off by the cleaning fluid. The cleaning fluid with the soldering tins flows through the filtering member 13 with the soldering tins filtered by the filtering film 132 of the filtering member 13. The cleaning fluid flowing into the second cleaning container 14 after a cleaning process can be used repeatedly.

In this position, a cleaning cycle for the plurality of nozzles 50 is finished. The cleaning cycle can be repeated according to practical requirements. That is, injection of air to the first cleaning container 11 and the second cleaning container 14 allows the cleaning fluid to circularly flow through the second cleaning container 14, the connection member 15, the first cleaning container 11, the supporting board 12, the securing board 16 and the filtering member 13 under the air pressure generated by airflow to clean the plurality of nozzles 50. As a result, the soldering tins that remain in inner surfaces of the hollow pipe 51 and the sucker 53 of the plurality of nozzles 50 can be effectively removed. After cleaning, the plurality of nozzles 50 is dried by the airflow in the first cleaning container 11.

While the exemplary embodiments have been described, it should be understood that it has been presented by way of example only and not by way of limitation. The breadth and scope of the disclosure should not be limited by the described exemplary embodiments, but only in accordance with the following claims and their equivalent.

What is claimed is:

1. A cleaning device to clean a plurality of nozzles of a surface-mount technology (SMT) machine, each of the plurality of nozzles comprising a hollow pipe, a baffle-board, and a sucker in communication with the hollow pipe, the cleaning device comprising:

a first cleaning container defining an first opening in a bottom thereof, a first air injecting hole to allow airflow into the first cleaning container, and a fluid injecting hole spaced from the first air injecting hole;

a supporting board connected to the bottom of the first container, and defining a plurality of first through holes to fix a plurality of sealing members so as to fix the plurality of nozzles;

a filtering member located at a bottom of the supporting board;

a second cleaning container connected to the filter member, and operable to receive cleaning fluid, wherein the second cleaning container defines a third opening at a top thereof, a second air injecting hole in a sidewall adjacent to the third opening of the second cleaning container to allow the airflow into the second cleaning container, and a fluid outgoing hole structured to release the cleaning fluid in the second cleaning container; and a connection member to connect the fluid injecting hole of the first cleaning container and the fluid outgoing hole of the second cleaning container, and to switch on or off communication between the first cleaning container and the second cleaning container;

wherein injection of air to the first cleaning container and the second cleaning container allows the cleaning fluid to circularly flow through the second cleaning container, the connection member, the first cleaning container, the supporting board, and the filtering member under air pressure generated by the airflow so as to clean the plurality of nozzles.

2. The cleaning device as claimed in claim 1, further comprising a securing board located between the supporting board and the filtering member.

3. The cleaning device as claimed in claim 2, wherein the securing board defines a plurality of recesses to receive the baffle-boards of the plurality of nozzles respectively, and defines a third through hole in a bottom of each of the plurality of recesses through which the sucker of each of the plurality of nozzles passes.

4. The cleaning device as claimed in claim 1, wherein the filtering member comprises a filtering container that defines a second opening in a top portion thereof and a receiving hole in a bottom portion thereof.

5. The cleaning device as claimed in claim 4, wherein the filtering member comprises a filtering film configured in the filtering container.

6. The cleaning device as claimed in claim 5, wherein the filtering container defines a step at an inner sidewall thereof to support the filtering film.

7. The cleaning device as claimed in claim 6, wherein the filtering member further comprises a sleeve disposed between the filtering film and the supporting board.

8. The cleaning device as claimed in claim 4, further comprising a non-returning valve mounted on the receiving hole.

9. The cleaning device as claimed in claim 1, wherein the second cleaning container defines a second round slot surrounding the third opening of the second cleaning container, and a second sealing ring is received in the second round slot so as to ensure that the filtering member is hermetically attached to the second cleaning container.

10. The cleaning device as claimed in claim 9, wherein the supporting board defines a first round slot at a top side thereof, a first sealing ring is received in the first round slot so as to ensure that the supporting board is hermetically attached to the first cleaning container.

11. The cleaning device as claimed in claim 1, wherein the connection member comprises a connection pipe to connect the fluid injecting hole of the first cleaning container to the fluid outgoing hole of the second cleaning container.

12. The cleaning device as claimed in claim 11, further comprising a pair of valves respectively mounted on the fluid injecting hole of the first cleaning container and the fluid outgoing hole of the second cleaning container.

* * * * *